US006037057A

United States Patent [19]

Hartzog et al.

[11] Patent Number: 6,037,057

[45] Date of Patent: Mar. 14, 2000

[54] SHEATH-CORE POLYESTER FIBER INCLUDING AN ANTIMICROBIAL AGENT

[75] Inventors: James Victor Hartzog, Kinston; Darren Scott Quinn, Goldsboro, both of N.C.

[73] Assignee: E. I. du Pont de Nemours and Company, Wilmington, Del.

[21] Appl. No.: 09/023,270

[22] Filed: Feb. 13, 1998

[51] Int. Cl.[7] ..... D02G 3/00

[52] U.S. Cl. ..... 428/373; 428/370; 428/375

[58] Field of Search ..... 428/370, 372, 428/373, 97

[56] References Cited

U.S. PATENT DOCUMENTS

| | | | |
|---|---|---|---|
| 5,047,448 | 9/1991 | Tanaka et al. | 523/122 |
| 5,447,794 | 9/1995 | Lin | 428/373 |
| 5,690,922 | 11/1997 | Mouri et al. | 424/76.1 |
| 5,834,089 | 11/1998 | Jones et al. | 424/97 |

*Primary Examiner*—Newton Edwards

[57] ABSTRACT

A sheath-core polyester fiber where the sheath includes an antimicrobial agent and the sheath comprises less than thirty percent of the total cross-sectional area of the fiber. The antimicrobial agent is selected such that the relative viscosity of the fiber lies above a defined spinnability limit, so that spinning is possible. With no loss in antimicrobial efficacy, the fiber of the present invention may be slickened with a siliconized finish in order to reduce fiber friction, thus giving the fiber a silky feel.

10 Claims, 5 Drawing Sheets

SHEATH-CORE POLYESTER FIBER INCLUDING AN ANTIMICROBIAL AGENT

FIELD OF THE INVENTION

The present invention concerns sheath-core polyester fibers having antimicrobial properties, and more particularly such fibers where the sheath includes an antimicrobial agent and comprises less than thirty percent of the total cross-sectional area of the fiber.

BACKGROUND OF THE INVENTION

All kinds of micro-organisms exist around us, and, in some instances, interfere with our ability to live healthy lives. Micro-organisms present in our clothing can multiply rapidly because the conditions are favorable due to the heat, humidity and available nutrients. Therefore, it has been very desirable to provide fibers that have antimicrobial activity to protect both the user and the fibers, and to do this economically. For convenience herein, the expression "antimicrobial" is used generally to include antibacterial, antifungal, and other such activity.

Proprietary antimicrobial acrylic and acetate fibers are currently commercially available. However, because polyester fibers have been the synthetic fibers that have been produced and used in the greatest quantities for many years, it would be desirable to have a polyester antimicrobial fiber with improvements over the existing commercially available acrylic and acetate antimicrobial fibers. Since only the antimicrobial agent on or near the surface of a fiber contributes to its antimicrobial effect, it has been considered desirable to provide as much of the antimicrobial agent as possible close to the peripheral surface of the fiber. Thus, it would be desirable to provide an antimicrobial polyester fiber where the antimicrobial agent is disposed in the sheath of a bicomponent sheath-core fiber, since the sheath is disposed near the surface of a fiber. Moreover, since antimicrobial agents are relatively expensive, it would be desirable to use as little of the agent as possible. Therefore, it would be desirable to make the sheath as small as possible. Although bicomponent antimicrobial polyester fibers have been suggested many times in the prior art, as will be related hereinbelow, so far as is known, a satisfactory polyester bicomponent antimicrobial fiber has not been commercially available.

Much effort has been directed at embedding metal ions, which have long been known to have an antimicrobial effect, in polymers to give antimicrobial activity in fibers. This effort in particular has been directed to incorporating metal containing zeolites into the polymer. For instance, Jacobson et al. in U.S. Pat. Nos. 5,180,585 (1993), 5,503,840 (1996) and 5,595,750 (1997) discloses the use of an antimicrobial composition comprising zeolites. However, Jacobson recognizes the problems of color deterioration associated with high metal loadings, as for example, experienced by zeolites, and instead proposes an antimicrobial composition which does not experience this problem, especially when incorporated in a polymer matrix.

In addition, the use of zeolites in sheath-core fibers is known. Hagiwara et al., in U.S. Pat. No. 4,525,410 (1985), discloses packed and retained metal zeolites in a mixed fiber assembly, such as sheath-core composite fibers, including polyester fibers (see col. 5, line 50 et seq.). Japanese Published Application Kokai No. Sho 62-195038 (1987, Kanebo, et al.) prepared polyester molded products from a hydrophilic substance and a polyester to retain metal zeolite particles, and suggested spinning conjugate sheath-core fibers. Hagiwara et al., U.S. Pat. No. 4,775,585 (1988), disclosed bactericidal metal ions at ion-exchange sites of zeolite particles in polymer articles, including fibers having a sheath-core structure (see col. 9, lines 3–6), and including conjugated yarns of polyethylene terephthalate; (see Example 2 in col. 14). Ando et al., in U.S. Pat. No. 5,064,599 (1991) included such ions at such sites in a low-melting component of conjugate fibers, including polyester components (see Examples 1 and 2). Nippon Ester, Japanese Published Application Kokai No. Hei 8 (1996)-120524, suggested a hollow sheath-core polyester fiber with a subliming insecticide in the hollow core polyester and a zeolite in the sheath polyester. Nakamura Kenji, Japanese Published Application Kokai No. Hei 9-87928 (1997) also suggested a sheath-core polyester fiber with a metal zeolite in the sheath. However, it has been found that the use of certain zeolites may produce unacceptable polymer and fiber degradation. See, for example, Sun-Kyung Industry (Ltd.), Korean Publication No. 92-6382 (1992), (hereinafter referred to as the Korean Publication) which discloses that zeolites have the capability to absorb or release water, and therefore degrade the properties of polyester fiber, which is easily hydrolyzed by water.

None of the patents or publications discussed above discloses a sheath comprising a relatively small percentage of the total cross-sectional area of the fiber. In fact, the Korean Publication discloses that it has been advisable not to reduce the amount of sheath below 30% of the cross-sectional area of the fibers in order to obtain good processing and physical properties. In particular, the Korean Publication discusses that if the sheath is less than 30% of the cross-sectional area of a fiber, the core may shift in one direction and protrude from the fiber surface to lower the antimicrobial effect of the fiber. In addition, when the sheath comprises more than 70% of the total fiber cross-sectional area, it is difficult to position the core component at the center of the fiber during spinning, and therefore the antimicrobial properties of the fiber cannot be improved further. This warning was confirmed by Teijin in Japanese Published Applications Kokai Nos. Hei 6-228,823 (1994) and Hei 7-54208 (1995), namely that the sheath-core weight ratio should be 30/70 to 70/30, or the sheath component would tend to break and spinning productivity would drop. Thus, Teijin preferred especially a sheath-core ratio of 45/55 to 55/45.

In addition, when an antimicrobial agent relies on the hydrophilic nature of a zeolite to impart antimicrobial properties, the use of a hydrophobic slickener on the fiber is precluded. Hence none of the patents or publications discussed above discloses use of a slickener with an antimicrobial agent, where the antimicrobial agent is added to the polymer during fiber manufacture, so that the agent is embedded in the fiber. It is known to apply an antimicrobial agent and a slickener to a fiber after the fiber is produced. However, this does not produce a fiber with a durable slickener or antimicrobial agent. Hence, there are no known commercially available antimicrobial fibers having an antimicrobial agent added during fiber manufacture, with a slickener applied to the surface of the finished fiber.

For all the reasons discussed above, it would be desirable to produce an antimicrobial polyester fiber which has effective antimicrobial properties, but which is not expensive to produce. In addition, it would be desirable to produce an antimicrobial polyester fiber which does not experience the problems of the prior art of discoloration and degradation, as well as those associated with spinning productivity. Moreover, it would be desirable to produce an antimicrobial polyester fiber having an antimicrobial agent added during fiber manufacture which fiber may be slickened.

SUMMARY OF THE INVENTION

The present invention solves the problems associated with the prior art by providing a sheath-core polyester fiber where the sheath includes an antimicrobial agent and comprises less than thirty percent of the total cross-sectional area of the fiber, so that the fiber is economical to produce, but yet has effective antimicrobial properties. With this configuration, the additive efficiency of the antimicrobial agent is maximized, since the agent is near the surface where it is most effective. Also, less antimicrobial agent needs to be used, which makes the antimicrobial fiber of the present invention more economical to produce than antimicrobial fibers of the prior art.

Moreover, the present invention solves the problems associated with the prior art by providing a sheath-core polyester fiber the antimicrobial agent is selected so that the problems of discoloration, degradation and spinning productivity of the prior art are avoided.

In addition, the present invention solves the problems associated with the prior art by providing a sheath-core polyester fiber having an antimicrobial agent embedded in the fiber, where a slickener may be used. The slickener reduces fiber friction, thus giving the fiber a silky feel.

Therefore, in accordance with the present invention, there is provided a sheath-core polyester fiber, where the sheath, which includes an antimicrobial agent, comprises less than thirty percent of the total cross-sectional area of the fiber. In particular, the sheath includes an antimicrobial agent selected such that the relative viscosity of the fiber lies above a defined spinnability limit, below which spinning will not occur. The fiber of the present invention may be slickened.

DETAILED DESCRIPTION

In accordance with the present invention, there is provided a sheath-core polyester fiber. It should be noted that the terms "fiber" and "filament" are generally used inclusively herein to include both cut fiber and continuous filaments. The fiber of the present invention is shown generally at 10 in FIG. 1. The fiber comprises a core 12 comprising a polyester and a sheath 14 comprising a polyester. The sheath includes an antimicrobial agent, which may comprise particles, which are shown at 16 in FIG. 1.

In accordance with the present invention, the sheath comprises less than 30% of the total cross-sectional area of the fiber. While it is desirable to have the sheath comprise as little of the cross-sectional area as possible, it is still necessary to maintain enough active area which has the antimicrobial agent to achieve an effective antimicrobial kill. Thus, sheaths which average at least about 15% up to about 30% of the cross-sectional area of the fibers are preferred for the present invention. It should be noted that sheath-core polyester fibers where the sheath comprises 20% of the cross-sectional area of the fiber have been successfully spun according to the present invention.

It has been found that spinning occurs when an antimicrobial agent is employed where the relative viscosity of the fiber lies above a spinnability limit as defined by the equation:

$$LRV=-0.0559\times(\%\ \text{SHEATH})+18.088 \quad (1)$$

Figure 2:
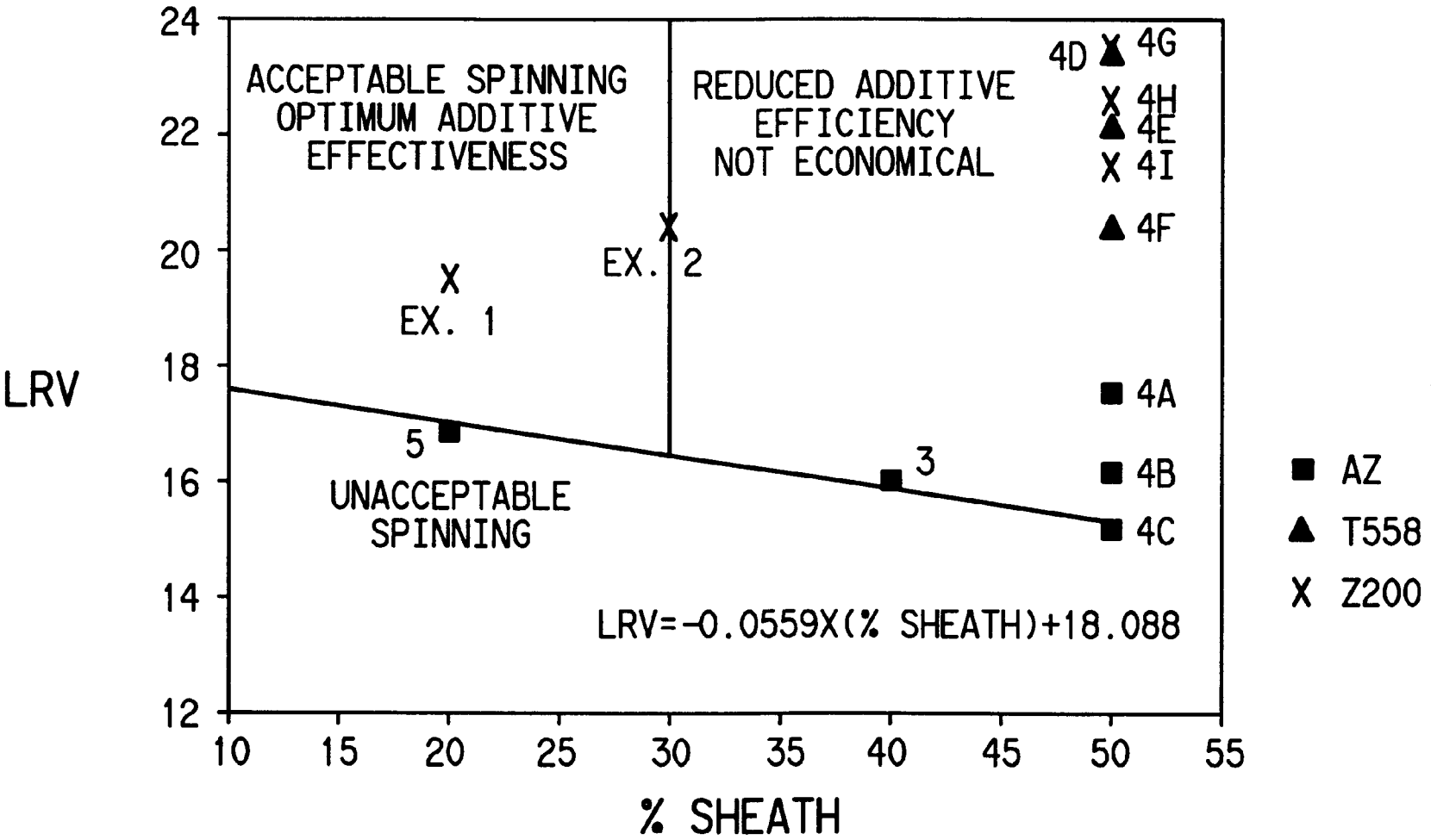
FIG. 2 is a graph showing the spinnability of fibers as a function of relative viscosity of the fiber and the percentage sheath of the fiber cross-sectional area.

This equation is shown in the graph of FIG. 2, which illustrates the spinnability of antimicrobial fibers, including those of the prior art and those of the present invention, as a function of relative viscosity of the fiber and sheath cross-sectional area. (Relative viscosity, as used herein, is measured as described in U.S. Pat. No. 5,223,187, and is described hereinbelow.) In particular, the spinnability limit, shown by the slanted line in FIG. 2, represents the points below which spinning will not occur. Above this line, spinning is possible. However, sheath-core fibers produced in accordance with the area to the right of the vertical line as shown in FIG. 2, representing sheaths of larger cross-sectional area, require a larger amount of antimicrobial agent than fibers produced in accordance with the area to the left of the vertical line, and are consequently less economical to produce. Also, such fibers exhibit reduced additive efficiency because the area in which the antimicrobial agent is disposed relative to the fiber surface area is not maximized.

In particular, it has been found that by using antimicrobial agents selected in accordance with the spinnability limit as defined by equation (1) above, polyester sheath-core fibers with sheaths of less than 30% of the cross-sectional area of fibers may be successfully produced. With such antimicrobial agents, it is possible to overcome the problems of spinnability related by Sun-Kyung Industry (Ltd.) in the Korean Publication and by Teijin in Japanese Published Applications Kokai Nos. Hei 6-228,823 and Hei 7-54208, supra, while at the same time maximizing the effectiveness of the antimicrobial agent.

Figure 1:
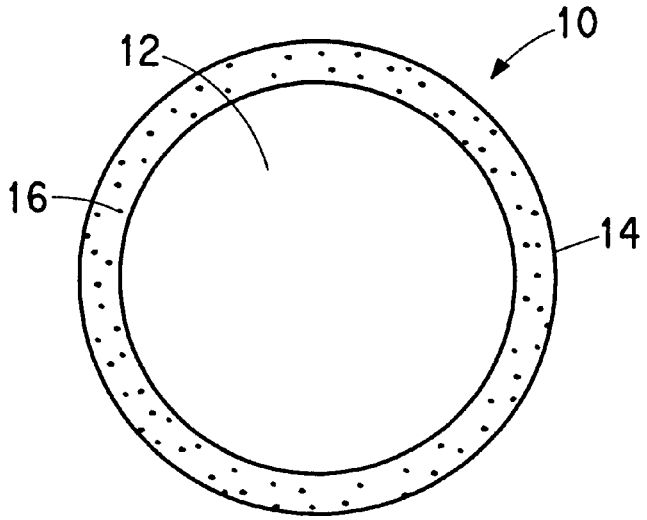
FIG. 1 is a cross-sectional view of a preferred sheath-core fiber according to the present invention.
Figure 3:
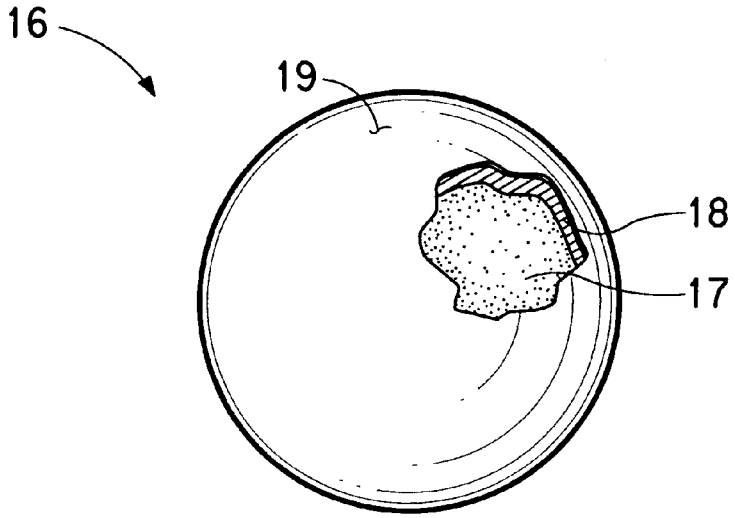
FIG. 3 is an enlarged, cross-sectional view of the antimicrobial agent shown in FIG. 1.

The antimicrobial agent of the present invention is shown at 16 in FIG. 1 as described in FIG. 1 and in more detail in FIG. 3. This agent may comprise an inert inorganic particle 17 having a first coating 18 which has antimicrobial properties and a second coating 19 which has protective properties as shown in FIG. 3. Such an antimicrobial agent is disclosed in U.S. Pat. No. 5,180,585 to Jacobson et al.

In particular, as disclosed in the '585 Patent, the inorganic particles, i.e., the core material, may be any of the oxides of titanium, aluminum, zinc, copper, the sulfates of calcium; strontium; zinc sulfide; copper sulfide; mica; talc; kaolin; mullite or silica. The average diameter of the core material is between 0.01 and 100 microns, preferably in the range of 0.1 to 5 microns. In general, core materials in the sub-micron size range are preferred, since the resulting antimicrobial composition can be distributed more uniformly throughout a polymer matrix.

The first coating conferring antimicrobial properties may be metallic silver or copper or compounds of silver, copper and zinc which have extremely low solubility in aqueous media. The antimicrobial particle should release silver, copper or zinc ions at an effective level of antimicrobial activity, e.g., a minimum of 2 log reduction within 24 hours in a Shake Flask Test (as defined hereinbelow), over a prolonged period, such as months or preferably years. Components which meet these criteria are silver, silver oxide, silver halides, copper, copper (I) oxide, copper (II) oxide, copper sulfide, zinc oxide, zinc sulfide, zinc silicate and mixtures thereof. The amount of antimicrobial coating on the core particle is in the range of 0.05 to 20% by weight, preferably 0.1 to 5% by weight, based on the material of the core particle. The core particles may also be optionally pre-coated with alumina in the amount of about 1 to 4% to ensure good antimicrobial properties after precipitation of the antimicrobial coating.

The secondary coating conferring protective properties may comprise either silica, silicates, borosilicates, aluminosilicates, alumina, or mixtures thereof. The secondary coating corresponds to 0.5% to 20% by weight based on the core particle, and preferably, e.g., 1 to 5% by weight of silica or, e.g., 1 to 6% by weight of alumina in the coated particle agent. The protective layer of silica or alumina can be quite dense, although it must be sufficiently porous to permit diffusion of the antimicrobial metal ions through the coating at a slow rate, while functioning as a barrier which limits interaction between the antimicrobial coating and the polymeric matrix in which it is distributed. For particles coated with silica or related materials with a low isoelectric point, a tertiary coating of hydrous alumina or magnesia, or other metal oxide, may be added to raise the isoelectric point. Dispersion aids may be incorporated in either the antimicrobial agent or in the process for incorporating them into the polyester of the fiber to facilitate dispersion in end use applications. Alternatively, alumina may be selected as the secondary protective coating and a tertiary coating may not be needed to adjust the isoelectric point.

In particular, it has been found that by using selected antimicrobial particles comprising either titanium oxide or zinc oxide in a sheath-core fiber, the difficulties associated with the use of prior art antimicrobial agents in sheath-core polyester fibers have been overcome. In particular, zinc oxide has been found to give especially good results with respect to color, as will be illustrated in Comparative Example 7 below. A titanium-dioxide based antimicrobial agent, designated as T558, and a zinc-oxide based antimicrobial agent, designated as Z200, are commercially available from E. I. du Pont de Nemours and Company of Wilmington, Del. under the trademark MicroFree™ Brand.

The zinc oxide based antimicrobial agent (Z200) ranges in size from 0.5 to 3.5 microns, unsonicated d50. The following percentages are given as percentage of the weight of the antimicrobial agent, or product, unless otherwise specified. The core particle comprises zinc oxide and ranges from 90–99%. The antimicrobial coating comprises 0.2% silver. The protective coating comprises a mixture of aluminum hydroxide and silica in the range of 1 to 5%. The agent also includes a dispersion coating of dioctylazelate, in the range of 0.1 to 1%. This dispersion coating gives the inorganic particle some organic character.

The titanium dioxide based antimicrobial agent (T558) ranges in size from 0.1 to 2.5 microns, unsonicated d50. The core particle comprises titanium dioxide and is in the range of 90–95%. The antimicrobial coating comprises 0.5% silver, 0.5% copper (II) oxide and 0.8% zinc silicate. As with Z200, the protective coating comprises a mixture of aluminum hydroxide and silica in the range of 1 to 5%. The agent also includes a dispersion coating of dioctylazelate, in the range of 0.1 to 1%.

Suitable polyester polymers for use for the sheath or the core according to the present invention include trimethylene terephthalate (3G-T) polymers as well as ethylene terephthalate (2G-T) polymers, which latter are the polyester polymers that have been most available commercially for several decades, as well as polybutylene terephthalate (4G-T). Copolymers may be used if desired and several have been disclosed in the art. The polyester of the sheath and the core are generally the same polymer. However, they may be different, as long as the total relative viscosity of the fiber lies above the spinnability limit defined above with respect to equation (1), below which spinning will not occur.

In addition, with the present invention, it is possible to use a slickening agent, which is hydrophobic, with no loss in antimicrobial efficacy. Thus, the outer surface of the fiber, where the antimicrobial agent is embedded in the sheath, may be slickened with a siliconized finish, such as a slickener containing a polyaminosiloxane. The slickener reduces fiber friction, thus giving the fiber a silky feel.

Figure 4:
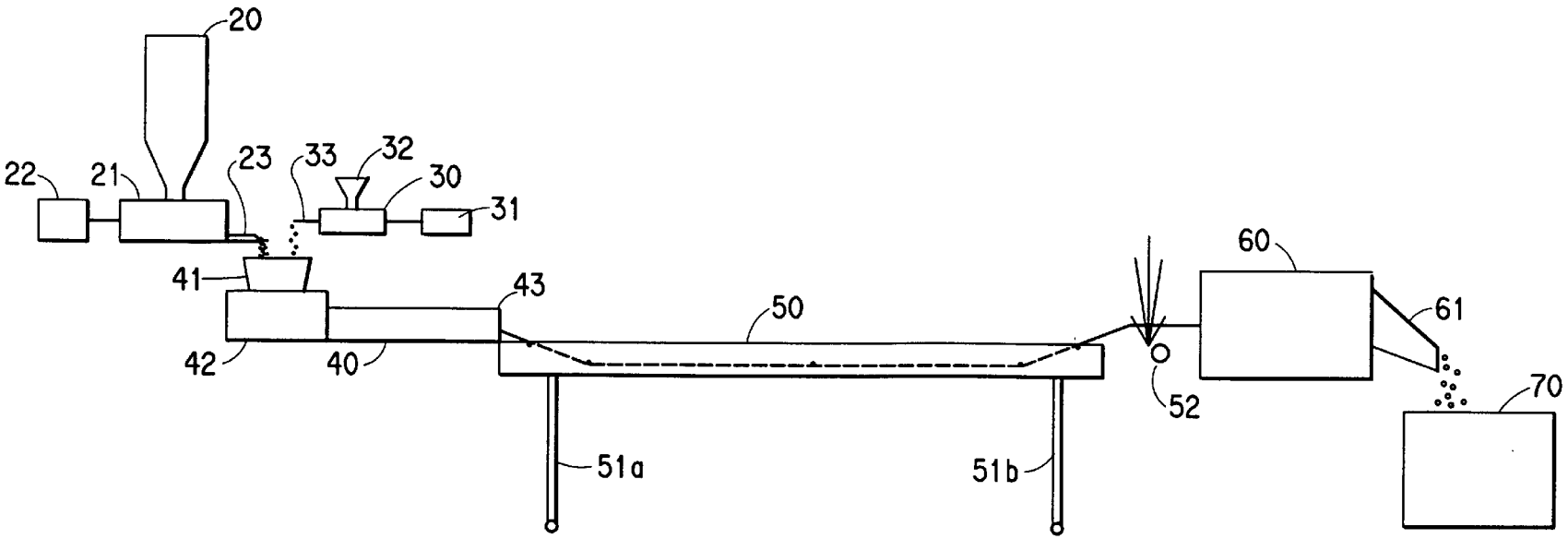
FIG. 4 is a schematic diagram showing the equipment used to make a polymer concentrate which is used to make the fiber of the present invention.
Figure 5:
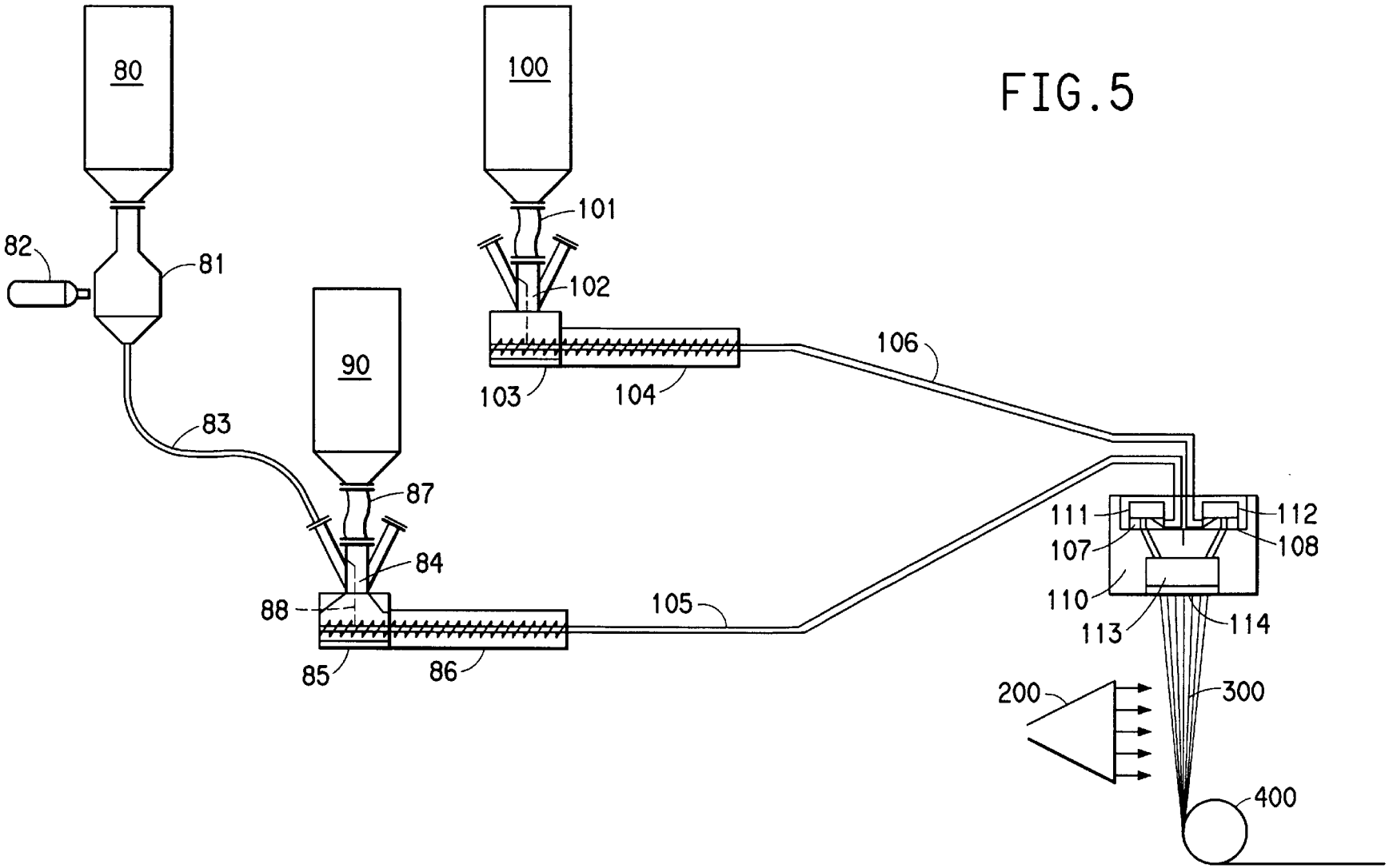
FIG. 5 is a schematic diagram showing one exemplary configuration of equipment used to blend and spin the polymers used to make the fiber of the present invention.

A process for producing a sheath-core antimicrobial polyester fiber is illustrated with respect to FIGS. 4 and 5. According to this process, an antimicrobial additive concentrate is first produced and later incorporated into the sheath polymer. An illustrative depiction of the concentrate preparation is given with respect to FIG. 4. In FIG. 4, a base 2GT (or PET) polymer flake is dried to a moisture content less than 50 ppm in hopper 20 using either desiccated air or nitrogen as the drying medium. This flake is then fed through a transfer chute 23 using a loss-in-weight feeder 21, driven by a variable speed motor 22, to a throat hopper 41 of a twin screw compounding extruder comprising the throat hopper 41, a feed section 42 and a barrel 40. Simultaneously and at a controlled ratio relative to the base flake feed through feeder 21, an antimicrobial agent residing in hopper 32 is metered through a transfer chute 33 to the extruder's throat 41, using a loss in weight feeder 30, which is driven by a variable speed motor 31. The base flake was then melted in the extruder barrel 40, and the antimicrobial additive dispersed throughout the molten polymer. This molten polymer/antimicrobial agent mixture was then extruded through a die 42, to form polymer/antimicrobial concentrate strands. These strands were then pulled by a strand cutter 60, through a quench bath 50, depicted with legs 51*a* and 51*b*, and containing water sufficiently cool so as to solidify the strands. Prior to entering the strand cutter, excess water is blown off the solidified strands using compressed air from a compressed air source 52. Speed and blade configuration of the strand cutter is set so as to form antimicrobial concentrate flake of a desired size. The cut antimicrobial concentrate flake passes through a chute 61 and is collected in a suitable receptacle 70.

The preparation of sheath-core synthetic polymer fibers is well known in the art, as described by, e.g., Killian in U.S. Pat. No. 2,936,482, by Bannerman in U.S. Pat. No. 2,989,798, and by Lee in U.S. Pat. No. 4,059,949, and also in the art referenced hereinabove. A bicomponent spinning technique which produces solid sheath-core bicomponent filaments of round cross-section is also known in the art and is described by Hernandez et al. in U.S. Pat. No. 5,458,971. FIG. 5 is a schematic diagram showing equipment that may be used for the preparation of sheath-core, antimicrobial fibers according to the present invention although it should be understood that known techniques for the production of sheath-core synthetic polymer fibers and of sheath-core bicomponent filaments as described above and in other prior may be used without departing from the spirit of the present invention. Per this schematic, the antimicrobial concentrate flake, produced as described with respect to FIG. 4, is first loaded into a dryer hopper 80. Within the dryer hopper 80, the concentrate is conditioned to less than 50 ppm moisture using desiccated air or nitrogen. Simultaneously, polymer flake for the sheath is dried to below 50 ppm moisture in a hopper 90 using desiccated air or nitrogen. The antimicrobial concentrate passes to a volumetric feeder 81, which is driven by a variable speed motor 82, and which meters the concentrate at a rate controlled to provide a given proportion of concentrate to the sheath polymer. The metered concentrate passes through a flake transfer pipe 86, to a transition piece 84 of a single screw extruder. This extruder comprises a feed section 85 and a barrel 86. The conditioned flake for the sheath gravity feeds through a transfer pipe 87 into the transition piece 84 of the aforementioned single screw extruder. A separator plate 88 is located within the transition piece 84, such that the flake concentrate is allowed to flow into the extruder's feed section 85 in a manner to insure intimate mixing of the antimicrobial concentrate and sheath flake. These intimately mixed flakes are then melted in the extruder barrel 86 to form a polymer melt containing a dispersed antimicrobial agent.

A polyester in the form of a polymer flake is also used to make the core. This flake is dried to below 50 ppm moisture in a hopper 100. This conditioned flake then passes through a transfer pipe 101 and a transition pipe 102 into a feed section 103 of a single screw extruder. The single screw extruder comprises the feed section 103 and a barrel 104, in which the flake is melted.

The molten polymers for the sheath, which contains the antimicrobial agent, and for the core are then respectively passed through polymer transfer lines 105 and 106 to one or more bicomponent spinning positions, of which only one is depicted in FIG. 4. The sheath and the core polymers pass respectively through wear plates 107 and 108 located on a heated spin beam 110. From these wear plates, the sheath and the core polymers pass into a pump 111 and a pump 112, respectively. These pumps force each polymer into a spin pack 113, where each polymer is separately filtered and metered through distribution plates configured such that the two polymers combine in a sheath-core configuration at the entrance of multiple spinning capillaries milled into a spinneret 114.

As the combined polymers are forced through the spinneret capillaries, they are subsequently solidified using forced air from a quench unit 200, forming sheath-core filaments 300. These filaments are then gathered together into a single rope around one or more godets 400. This rope is then wound onto a tube or deposited into a suitable receptacle depending on the further processing of the filaments desired.

The invention will be further explained in the following Examples, which are intended to be purely exemplary. The following test methods were used in the Examples.

1. Relative Viscosity

As noted above, relative viscosity is measured as described in U.S. Pat. No. 5,223,187. In particular, this '187 Patent discloses that relative viscosity (LRV) is a sensitive and precise measurement indicative of polymer molecular weight. LRV is the ratio of the viscosity of a solution of 0.8 grams of polymer dissolved at room temperature in 10 ml of hexafluoroisopropanol containing 100 ppm sulfuric acid to the viscosity of the sulfuric acid containing hexafluoroisopropanol itself, both measured at 25° C. in a capillary viscometer. The use of hexafluoroisopropanol as a solvent is important in that it allows dissolution at the specified temperature and thereby avoids the polymer degradation normally encountered when polyesters are dissolved at elevated temperatures. LRV values of 38 and 44 correspond roughly to intrinsic viscosity values of 0.90 and 0.95, respectively, when the intrinsic viscosity is measured at 25° C. in a solvent composed of a mixture of trifluoroacetic acid and methylene chloride (25/75 by volume).

2. Shake Flask Test

Antimicrobial activity was measured using the Shake Flask Test as described in U.S. Pat. No. 5,180,585 to Jacobson et al., supra. And as described specifically hereinbelow. The Shake Flask Test requires the test material to be in a form having a high surface area to weight ratio. Articles having the form of powders, fibers, and thin films have proven to be acceptable.

The bacterial inoculum for the Shake Flask Test was prepared by transferring 2.0 ml of an overnight broth culture to a 300 ml nephyloculture flask (Bellco Glass Inc., Vineland, N.J.) containing 100 ml of Tryptic Soy Broth (TSB) (Remel, Lexena, Kans.). This flask was incubated at 37° C., with shaking (ca. 200 rpm). Growth of the culture was determined during incubation using a Klett-Summerson photoelectric calorimeter (Klett Mfg. Co., New York, N.Y.). When the culture reached late-log phase (185–200 Klett units for *Klebsiella pneumoniae* ATCC 4352), appropriate dilutions were made with sterile 0.2 mM phosphate buffer (pH 7).

This inoculum was then placed into sterile, disposable 250 ml Erlenmeyer flasks (Corning Glass Co., Corning, N.Y.) containing 0.75 g of the material produced by the process of this invention or a suitable control material as indicated below. Each flask contained a known concentration of bacteria in a final volume of 75 ml phosphate buffer.

The initial concentration of bacteria used in the various examples was determined by serial dilution of the inoculum (0.2 mM Phosphate buffer, pH 7) and plating in triplicate on Trypticase Soy Agar (TSA) plates (sold commercially by BBL, Cockeysville, Md.). The flasks were shaken on a Burrell wrist action shaker (Burrell Corp., Pittsburgh, Pa.). A 1.2 ml aliquot was removed from each flask after shaking for 1 hour (or other appropriate time interval as indicated). Duplicate petri plates containing TSA were inoculated via spread plating with 0.1 ml each of the sample. The remaining 1.0 ml was serial diluted and plated in duplicate. The TSA plates were incubated at 37° C. for 18 to 24 hours. Plates having between 30 and 300 colonies were counted and the bacterial concentration determined from the mean of the plate counts. If none of the plates contained at least 30 colonies, all colonies were counted and the bacterial concentration determined from the mean of the plate counts. Below the limit of detection of the procedure described herein, the colony count was said to be zero.

Antimicrobial activity was determined by the formulas:

$$kt=\log10(Co)-\log10(Ct+1) \quad (2)$$

$$Dt=\log10(CFt)-\log10(Ct+1) \quad (3)$$

where:

Co=initial concentration of bacteria (cfu/ml) in test flask at time zero

Ct=concentration of bacteria (cfu/ml) in test flask at time t (one is added to the number to avoid calculating the log of zero), CFt=concentration of bacteria (cfu/ml) in control flask at time t, and cfu/ml=colony forming units per milliliter.

The relationship between percent reduction and log reduction is conveniently seen by reference to the following:

| % Reduction | Kt | Log Reduction |
|---|---|---|
| 90 | 1 | 1 |
| 99 | 2 | 2 |
| 99.9 | 3 | 3 |
| 99.99 | 4 | 4 |
| 99.999 | 5 | 5 |

3. Color Measurement Test

Spun yarns were wound onto a 3 inch by 4 inch white cardboard holder using a card winder. The spun yarn formed a 3 inch by 2.5 inch area of parallel filaments four layers deep to completely cover the holder. The yarns were held in place by taping them to the back of the sample holder.

The instrument used for the measurement was a Hunterlab Digital Color Difference Meter Model D25M-9 consisting of an Optical Sensor module with a 2 inch port and Signal Processor Module. The color meter analyzes reflected light from test specimens in terms of L (white-black), a (red-green) and b (blue-yellow). These color values can be measured with the UV filter either included or excluded. Values reported herein have the UV component included. The instrument is calibrated and standardized using a set of plates provided with the instrument.

The sample is inspected to ensure the omission of stains, dirt, foreign materials, etc. The sample is placed on the adapter plate, avoiding loose ends or other irregularities. The instrument is activated to read the L, a, and b color values. The instrument also displays the whiteness value derived from the L and b values (Whiteness=0.01×L color (L color−[5.72×b color]).

EXAMPLES

In the following Examples, all parts, percentages and ratios are by weight unless indicated otherwise, with OWF indicating the level of finish on the weight of the fiber.

The Z200 and T558, referred to in the Examples, are as described above. B558, also referred to in the Examples, is described as a barium sulfate-based antimicrobial agent and ranges in size from 0.3 to 2.5 microns, unsonicated d50. The core particle comprises barium sulfate and is in the range of 90–95%. As with T558, the antimicrobial coating comprises 0.5% silver, 0.5% copper (II) oxide and 0.8% zinc silicate. As with Z200 and T558, the protective coating comprises a mixture of aluminum hydroxide and silica in the range of 1 to 5%. The agent also includes a dispersion coating of dioctylazelate, in the range of 0.1 to 1%.

Bactekiller® AZ, referred to in the Examples below, is a zeolite-based antimicrobial particle containing silver and zinc metal ions which is commercially available from Kanebo USA. The polyester polymer of both the sheath and the core was 2G-T polymer of 23.5 LRV, which was measured as described above.

EXAMPLE 1

2G-T polymer flake of 23.5 LRV was used to make the antimicrobial agent concentrate pellets, as described above with respect to FIG. 4. The concentrate pellets were dried using desiccated air at about 166° C. before being processed for bicomponent spinning, as for example at 80 in FIG. 5. 2G-T polymer flakes were also used for the sheath polymer and the core polymer, respectively. The 2G-T polymer flakes for the sheath were dried using desiccated air at temperatures of about 160° C., such as in hopper 90 in FIG. 5, and for the core at temperatures of about 150° C., such as in hopper 100 in FIG. 5. The polymer for the sheath was processed through a single screw extruder, such as extruder 85, 86 as shown in FIG. 5, that had been modified so that the additive concentrate was volumetrically metered to provide 6% (by weight) of antimicrobial powder in the sheath of the filaments, this extruder operating at a discharge temperature of 277° C. and a rate of 252 lbs (144 kg) per hour. The polymer for the core was processed through a conventional single screw extruder, such as extruder 103, 104 in FIG. 5, operating at a discharge temperature of 283° C. and a rate of 1008 lbs (457 kg) per hour.

The two molten polymer streams were combined at the entrance to the spinneret capillaries of a spinning machine in a 1:4 ratio, i.e, to provide 20% sheath (containing 6% of antimicrobial powder) and 80% core, using a meter plate with orifices just above each of 1176 round spinneret capillaries and spun into round filaments at a polymer temperature of 282° C. and a throughput of 1.353 gm/min/cap. The freshly-extruded filaments were quenched with a flow of cross-flow air at 55° F. (about 13° C.) and 950 cu. ft (about 27 cu. meters)/min, and were withdrawn at 704 meters/min. Spinning performance was excellent with no spinning breaks, nor bending of filaments (dog-legging) at the face of the spinneret. The resulting bundles of filaments of 17.3 dpf (19.2 dtex) were grouped together and drawn conventionally in a hot wet spray draw zone at 95° C., using a draw ratio of 3.4×, stuffer box crimped to 7 crimps per inch (2.8 crimps/cm), relaxed by heating in an oven at 137° C. for 10 minutes and cooled, an antistatic finish was applied at about 0.12% OWF, and the resulting filaments of 6.5 dpf (7.2 dtex) were cut to a length of 2 inches (5 cm).

The antimicrobial activity (for Klebsiella Pneumoniae) of the resulting fibers (Item A) was determined on a staple pad of the fibers made by opening and blending fibers using a Rotorring, Model 580, commercially available from Spinlab of Knoxville, Tenn., and configuring 0.75 g into a 2.5 $cm^2$ pad using the "Shake Flask Test" as described above. The 24 hr Kt Log Reduction and 24 hr KT % Reduction values are given in Table 1 for Item A and for Items B and Comparison C, described hereinafter.

B. Item B was prepared in a manner similar to that described with respect to Item A, except that an aminosiloxane finish was applied at 0.75% OWF after crimping and cured by heating in the oven at 180° C.

Comparison C. This Comparison was prepared without any antimicrobial powder by spinning 2G-T polymer of 20.4 LRV at a polymer temperature of 289° C. through 363 capillaries at a throughput of 2.108 gm/min/cap at a withdrawal speed of 1168 mpm to give hollow round filaments of dpf 16.3 (18.1 dtex) and a single central void of 18% (by volume), that were drawn at a ratio of 3.32×, otherwise similarly, stuffer box crimped to 9.2 crimps per inch (3.6 crimps/cm), and slickened with only 0.5% aminosiloxane OWF but otherwise as for Item B.

TABLE 1

| | 24 HR. KT REDUCTION | |
|---|---|---|
| ITEM | LOG REDUCTION | % REDUCTION |
| A | 4.4 | >99.99% |
| B | 4.4 | >99.99% |
| C | NA | 0% |

Table 2 shows the % Reduction values for 3 blends containing varying proportions of Item B blended with the remainder being Item C (having no antimicrobial powder).

TABLE 2

| B/C | % REDUCTION |
|---|---|
| 10/90 | 97.5% |
| 15/85 | >99.99% |
| 20/80 | >99.99% |

EXAMPLE 2

The sheath-core fiber of Example 2 was prepared in a manner similar to that described with respect to Item A of Example 1, except that the antimicrobial concentrate was metered so as to provide 5% by weight of antimicrobial powder in the sheath of the filaments. In addition, the sheath and core polymer streams were combined in a 3:7 ratio to yield a 30% sheath (containing 5% of antimicrobial agent). This Example is denoted as Ex. 2 in Table 3 below.

COMPARATIVE EXAMPLE 3

The sheath-core fiber of this comparison was prepared in a manner similar to that described for Item A in Example 1, except that the antimicrobial agent used was Bactekiller® AZ, which is a zeolite-based antimicrobial particle containing silver and zinc metal ions, commercially available from Kanebo USA. The antimicrobial agent was metered at a rate to give 40% by weight additive in the sheath polymer. The sheath and core polymers were combined in a 2:3 ratio to give a bicomponent fiber with a 40% sheath. This example is denoted as Item 3 in Table 3 below.

COMPARATIVE EXAMPLE 4

Polyester sheath-core bicomponent fibers were prepared by first drying PET (2GT), core polymer flake of 23.5 LRV in a vacuum dryer for 24 hours to lower the moisture content to less than 50 ppm. For the sheath polymers, PET (2GT) flakes of 23.5 LRV and PET flake concentrates comprising 20% of the antimicrobial agent specified in Table 3 were blended at appropriate ratios to give the sheath polymers with the level of the specified antimicrobial agent shown in Table 3. These flake mixtures were dried in a vacuum dryer for 24 hours to lower the moisture content of the flake mixtures to less than 50 ppm. For each of the items 4A through 4I, the sheath polymers specified in Table 3 were processed through a single screw extruder at a discharge temperature of 295° C. The core polymer in each case was processed through a separate single screw extruder operating at the same discharge temperature. The two molten streams were combined in a 1:1 ratio to provide a 50% sheath comprising the antimicrobial agent and a 50% core, using a meter plate with orifices just above each of 144 round spinneret capillaries and spun into round filaments at a polymer temperature of 290° C. and a throughput of 1.050 gm/min/cap. The filaments were allowed to "free-fall" through a cross-flow of 55° F. (12.7° C.) air and collected for analysis.

COMPARATIVE EXAMPLE 5

A comparison item was produced essentially as specified in comparative Example 4, except that the sheath and core polymers were combined in a 1:4 ratio to give a 20% sheath, containing 1.5% Bactekiller® AZ. This Comparative Example is denoted as Item 5 in Table 3.

Viscosity (LRV) results of the resultant fibers from Examples 1 and 2 and for Comparative Examples 3, 4 and 5 are shown in Table 3, which also specifies the articular antimicrobial agent used, the percent sheath and the percent of antimicrobial agent in the sheath.

TABLE 3

EFFECT OF ANTIMICROBIAL ADDITIVE ON POLYMER LRV

| | | % ADDITIVE | | |
|---|---|---|---|---|
| ITEM | ADDITIVE | % SHEATH | IN SHEATH | LRV |
| 4A | AZ | 50% | 1.0% | 17.6 |
| 4B | AZ | 50% | 2.0% | 16.1 |
| 4C | AZ | 50% | 3.0% | 15.2% |
| 3 | AZ | 40% | 1.25% | 16.0* |
| 5 | AZ | 20% | 1.5% | 16.9* |
| 4D | T558 | 50% | 1.0% | 23.5 |
| 4E | T558 | 50% | 2.0% | 22.1 |
| 4F | T558 | 50% | 3.0% | 20.4 |
| 4G | Z200 | 50% | 1.0% | 23.4 |
| 4H | Z200 | 50% | 2.0% | 22.5 |
| 4I | Z200 | 50% | 3.0% | 21.4 |
| Ex. 2 | Z200 | 30% | 5.0% | 20.3 |
| Ex. 1 | Z200 | 20% | 6.0% | 19.5 |

*Would not spin

* Would not spin

The items listed in Table 3 are shown in FIG. 2, discussed above, which is a representation of the relationship between percent sheath and LRV. In particular, FIG. 2 shows a plot of fiber LRV as a function of the percent of antimicrobial additive present in the sheath of the 50:50 sheath:core bicomponent fibers produced from each of these items. In this Figure it should be noted that only items above the line defined by the equation LRV=−0.559×(% Sheath)+18.088 gave acceptable spinning. This "Spinnability line" and its dependence on % sheath further defines the property well known in the art, for instance in Korean publication No. 92-6382 mentioned earlier, that zeolite based antimicrobial agents do not spin well at sheaths below 30%. It is apparent from the chart, however, that at all sheath percentages evaluated, both Z200 and T558 were well above the spinnability line. This is true even in the extreme case where antimicrobial agent loading in the sheath is at 6% and a 20% sheath is used.

COMPARATIVE EXAMPLE 6

As has been noted earlier, AZ and other antimicrobial agents are capable of being spun at sheath percentages of 30% or more. However, as also mentioned earlier, it is advantageous to put the antimicrobial compound near the surface, since it is through the surface that the antimicrobial agent interacts with the environment. This is well known in the art and is demonstrated through the following Comparative Example.

Figure 6:
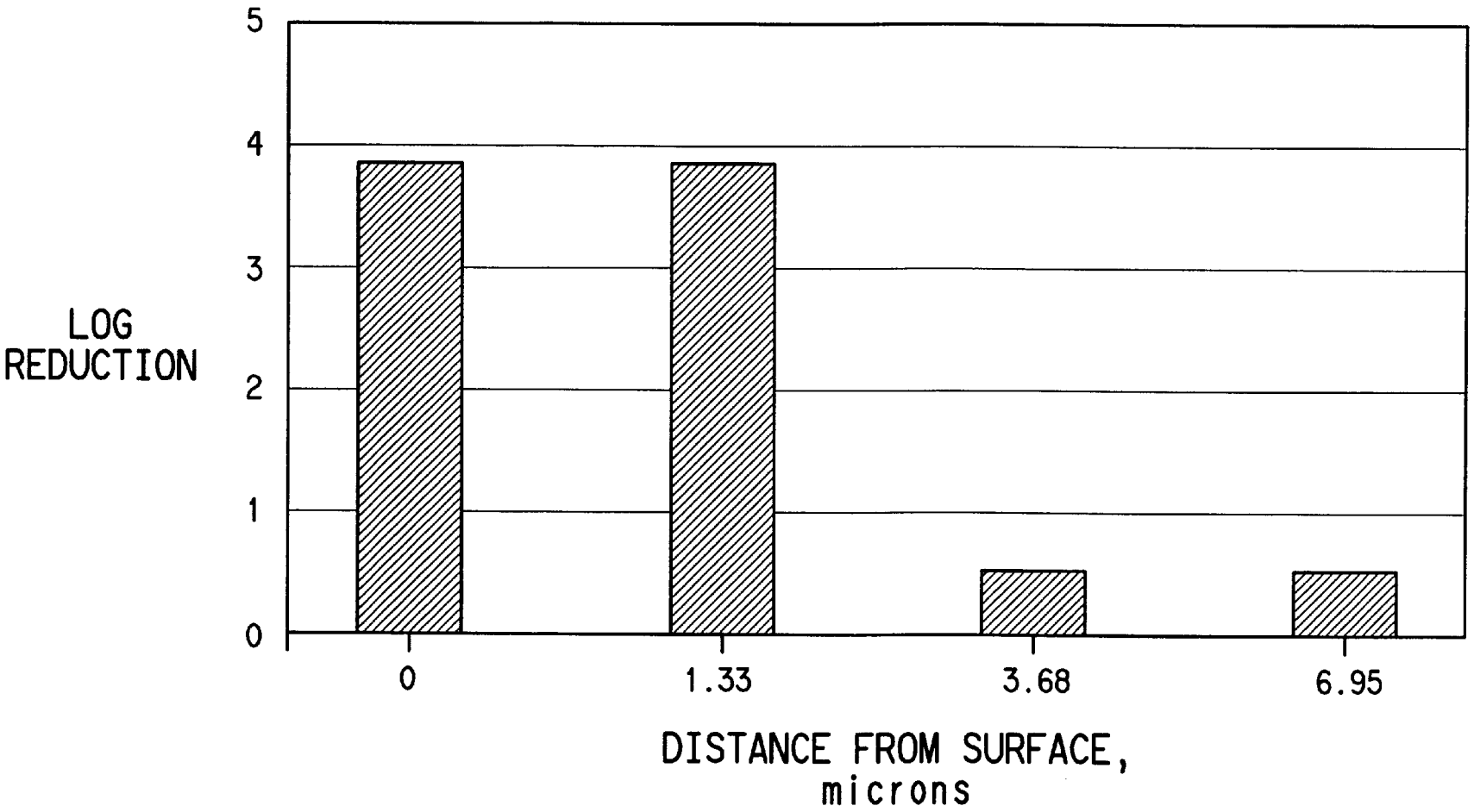
FIG. 6 is a bar graph showing the effect of the antimicrobial agent from the fiber surface.

Conjugated fibers were produced as per Comparative Example 4 with the exception that in this case the antimicrobial agent used was solely Bactekiller® AZ at a 1% level, and the antimicrobial agent was placed solely in the core rather than the sheath. In one case for comparison, no sheath polymer was used, thus resulting in a single component, antimicrobial fiber. Table 4 lists these items. Column 2 of this Table shows the distance from the surface of the sheath/core interface for the 6 dpf fibers. As illustrated in FIG. 6, the efficacy of the fiber as an antimicrobial product drops tremendously as the distance of the antimicrobial agent from the surface increases from 1.33$\mu$ (microns)

corresponding to a 20:80 sheath:core ratio to 3.68$\mu$ corresponding to a 50:50 sheath:core ratio.

TABLE 4

EFFECT OF AGENT DISTANCE FROM FIBER SURFACE (6 DPF FIBER, *LKEBSEILLA PNEUMONIAE* BACTERIA)

| % CORE | AGENT DISTANCE MICRONS | LOG REDUCTION |
|---|---|---|
| 20% | 6.95 | 0.5 |
| 50% | 3.68 | 0.5 |
| 80% | 1.33 | 3.9 |
| 100% | 0 | 3.9 |

COMPARATIVE EXAMPLE 7

Flake containing antimicrobial agent was blended and dried as described in Comparative Example 4 above. Equal quantities of the flake were extruded through each of two single screw extruders and combined at the entrance to each of 144 round spinneret capillaries to produce a bundle of monofilament fibers, all containing the antimicrobial agent throughout the fiber. The throughput per capillary was 1.471 gm/cap/min., and the spinning temperature was 290° C. The throughput per capillary was 1.471 gm/cap/min., and the bundle of fibers was collected at 900 ypm.

Fiber color was measured using a Hunter Lab D25M-9 Colorimeter. Results are given in Table 5, where "b Color" is a measure of yellowness. It can be seen that Z200, and to some extent T558, offers color advantages in polyester over both the zeolite-based AZ and the barium sulfate-based B558. A higher b Color and a resultant lower whiteness value indicate increased degradation.

TABLE 5

EFFECT OF ADDITIVE ON POLYMER COLOR

| ADDITIVE | % SHEATH | % ADDITIVE | L COLOR | b COLOR | WHITENESS |
|---|---|---|---|---|---|
| AZ | 100% | 0.5% | 80.89 | 8.8 | 24.5 |
| B558 | 100% | 0.5% | 82.12 | 8.9 | 25.8 |
| T558 | 100% | 0.5% | 85.30 | 8.3 | 32.2 |
| Z200 | 100% | 0.5% | 84.14 | 2.6 | 58.3 |
| AZ | 100% | 1.5% | 75.35 | 11.5 | 7.2 |
| B558 | 100% | 1.5% | 76.17 | 14.7 | −6.2 |
| T558 | 100% | 1.5% | 85.33 | 11.6 | 15.5 |
| Z200 | 100% | 1.5% | 77.50 | 5.8 | 34.4 |
| Z200* | 20% | 6.0% | 79.70 | 6.8 | 34.0 |

*Itam A, Example 1

What is claimed is:

1. A sheath-core polyester fiber comprising a polyester core and a polyester sheath, wherein the sheath includes an antimicrobial agent and the sheath comprises less than 30% of the cross-sectional area of the fiber.

2. The sheath-core polyester fiber of claim 1, wherein the fiber has a relative viscosity, and the relative viscosity of the fiber lies above a spinnability limit as defined by the equation:

$$LRV = -0.0559 \times (\%\ \text{SHEATH CROSS-SECTIONAL AREA}) + 18.088$$

3. The sheath-core polyester fiber of claim 1, wherein the antimicrobial agent is a composition comprising an inert inorganic core particle including a first coating comprising a metal having antimicrobial properties and a second coating having protective properties.

4. The sheath-core polyester fiber of claim 3, wherein the inorganic core particle is selected from the group consisting of the oxides of titanium, aluminum, zinc, copper; the sulfates of calcium and strontium; zinc sulfide; copper sulfide; mica; talc; kaolin; mullite and silica.

5. The sheath-core polyester fiber of claim 3, wherein the first coating is selected from the group consisting of silver, silver oxide, silver halides, copper, copper (I) oxide, copper (II) oxide, copper sulfide, zinc oxide, zinc sulfide, zinc silicate and mixtures thereof.

6. The sheath-core polyester fiber of claim 4, wherein the second coating is selected from the group consisting of silica, silicates, borosilicates, aluminosilicates, alumina, aluminum phosphate and mixtures thereof.

7. The sheath-core polyester fiber of claim 4, wherein the inorganic particle is an oxide of zinc.

8. The sheath-core polyester fiber of claim 4, wherein the inorganic particle is an oxide of titanium.

9. The sheath-core polyester fiber of claim 2, wherein the antimicrobial agent is added to the sheath during the manufacture of the fiber, and a slickener is added to the surface of the fiber after the manufacture of the fiber.

10. A sheath-core polyester fiber comprising a polyester core and a polyester sheath and including an antimicrobial agent embedded in the sheath during the manufacture of the fiber, wherein the fiber is slickened after the manufacture of the fiber.

* * * * *